United States Patent [19]

Arato

[11] 4,078,792

[45] Mar. 14, 1978

[54] HOLLOW PERFORATED CUSHION RECREATIONAL TOY

[75] Inventor: Oscar T. Arato, Willowdale, Canada

[73] Assignee: Can Sport Products Ltd., Scarboro, Canada

[21] Appl. No.: 694,610

[22] Filed: Jun. 10, 1976

[30] Foreign Application Priority Data

Feb. 18, 1976 Canada ..... 246039

[51] Int. Cl.[2] ..... A63G 31/12; A63B 5/18

[52] U.S. Cl. ..... 272/1 B; 5/347; 239/211; 239/567; 401/186; 401/204

[58] Field of Search ..... 272/1 R, 1 B, 1 E, 100, 272/101, 109, 113, 116, 130, 135, 144, 900, 65, 66; 46/91; 239/289; 5/337, 338, 341, 344, 345 R, 347, 365, 317 D, 317 R, 567, 553.3, 211; 401/186, 205, 264, 203, 204; 15/104.92; 4/184, 158; 182/137, 51, 52

[56] References Cited

U.S. PATENT DOCUMENTS

| | | | |
|---|---|---|---|
| 1,064,641 | 6/1913 | Halstead | 401/28 |
| 1,829,287 | 10/1931 | Lovett | 401/204 |
| 1,918,874 | 7/1933 | Shannahan | 239/211 X |
| 2,791,466 | 5/1957 | Crisp | 239/567 X |
| 3,176,982 | 4/1965 | O'Daniell | 272/1 B |
| 3,195,818 | 7/1965 | Herberg | 239/567 X |
| 3,214,783 | 11/1965 | Perry et al. | 401/186 X |
| 3,231,145 | 1/1966 | Converse | 401/186 |
| 3,242,511 | 3/1966 | Fultz et al. | 5/347 X |
| 3,486,177 | 12/1969 | Marshack | 5/347 |

*Primary Examiner*—Richard C. Pinkham
*Assistant Examiner*—Arnold W. Kramer
*Attorney, Agent, or Firm*—Sim & McBurney

[57] ABSTRACT

This invention provides a recreational toy in the form of a perforated cushion having a connection adapted to receive water from a garden hose or the like, and a plurality of perforations distributed over the upper surface. The cushion is non-circular and is capable of maintaining a stable position in which the perforations are uppermost. Because of the distribution of the perforations, a person jumping on the perforated cushion at any location on the upper surface which cause a depression and a corresponding increase in the water pressure inside the cushion, whereby the spray jets emanating from the perforations increase in height and force, and also turn inwardly toward the cause of the depression.

4 Claims, 5 Drawing Figures

HOLLOW PERFORATED CUSHION RECREATIONAL TOY

This invention relates to a perforated cushion item intended for play purposes.

It is an aspect of this invention to provide a recreational item for play purposes, which is designed to be filled with water and which is so configured that it provides a plurality of spray jets of water which change direction automatically when a localized downward force is applied against the surface of the recreational item, the change of direction being such as to cause the sprays to turn toward the cause of the force.

Accordingly, this invention provides a hollow perforated cushion for play purposes, the cushion being of flexible, water impervious material and having an inlet connection for receiving the end of a water-delivery hose, the cushion when on the ground and filled with water under pressure assuming a shape which yields a non-circular substantially oval section in any vertical intersecting plane, whereby to define a stable upper surface and to resist rolling over the ground, said stable upper surface being provided with a plurality of perforations therethrough whereby a constant delivery of pressurized water to said cushion will give rise to spray jet sets at the perforations, the perforations being distributed over said upper surface including areas adjacent its edges, such that a downward localized force applied against said upper surface at any location thereon will increase the water pressure inside said cushion to increase the height and force of said spray jets, and will also depress said surface adjacent said location so that the perforations in the depressed area turn towards the cause of the downward localized force; and at least one web extending vertically across the least dimension of the oval-shaped cushion, the web being attached to the inside of the cushion at the top and at the bottom.

Two embodiments of this invention are illustrated in the accompanying drawings, in which like numerals denote like parts throughout the several views, and in which.

Figure 1:
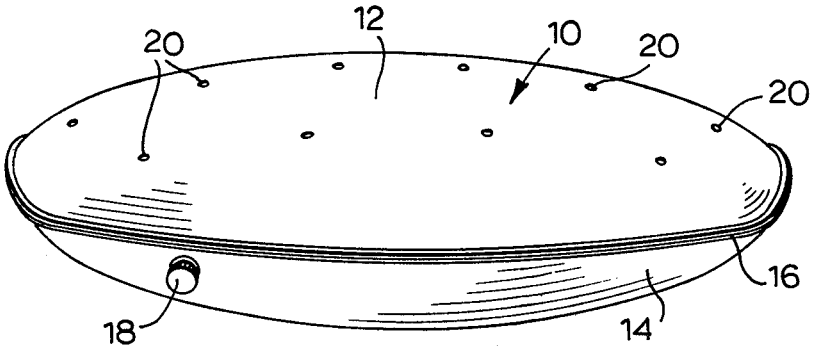
FIG. 1 is a perspective view of a recreational item according to one embodiment of the present invention.

Attention is directed first to FIG. 1 which shows a recreational item 10 which includes generally an upper panel 12 and a lower panel 14, the two panels 12 and 14 being secured in a water-tight manner together along a bead 16, either by stitching, heat-sealing means, a combination of these, or any other appropriate conventional sealing means. An inlet hose connection of a conventional type is shown at 18, and constitutes an inlet for pressurized water from a standard garden hose or other similar water-delivery conduit, to the internal chamber defined between the two panels 12 and 14.

A preferred material from which the panels 12 and 14 are manufactured is PVC of around 14 gauge. This material is flexible and to some extent resiliently extendable, such that the two panels 12 and 14 may be cut from flat rather than curved material, sealed together around the circumferential bead 16, and still permit a considerable quantity of water to be received between them through their capacity to resiliently and flexibly distort.

Figure 2:
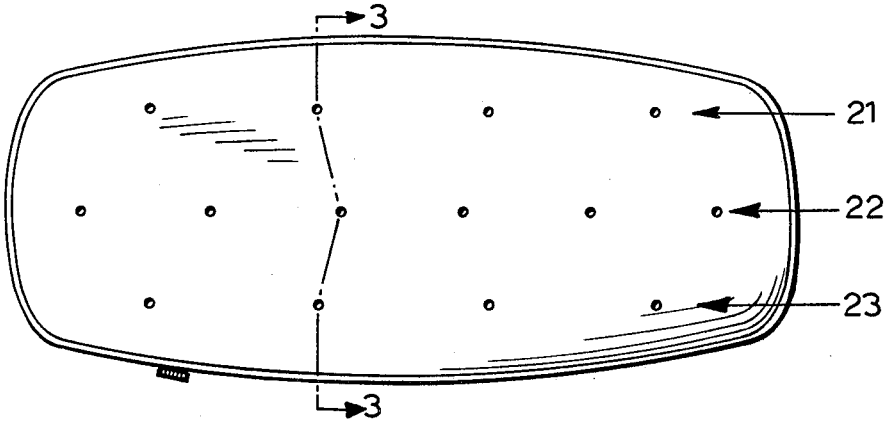
FIG. 2 is a plan view thereof.

The upper panel 12 contains a plurality of individual, spaced-apart perforations which are generally distributed over the upper surface constituted by the panel 12, including the areas adjacent its edges, such that a downward localized force applied against the panel 12, for example by a person jumping with his feet downwardly against the panel 12, will increase the water pressure inside the recreational item 10 thereby either causing or reinforcing spray jets of water from the perforations. The perforations are identified by the numeral 20 and one distribution configuration is that shown in FIG. 2, where there are provided three parallel lines of perforations 21, 22 and 23, with six perforations substantially evenly spaced along the center line 22, and with four perforations in each of the outer lines 21 and 23.

The water inlet connection 18 preferably incorporates a check-valve, such that the garden hose or other waterconducting conduit may be disconnected from the recreational item 10 and still allow the item to function in the desired way for a limited period of time.

Figure 3:
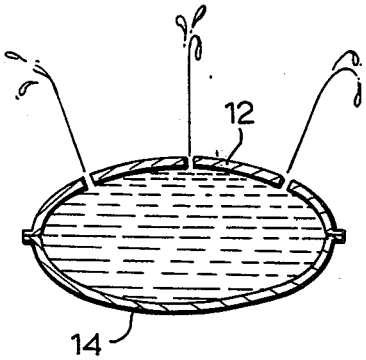
FIG. 3 is a vertical sectional view taken of the line 3—3 of FIG. 2 without any localized force being applied.
Figure 4:
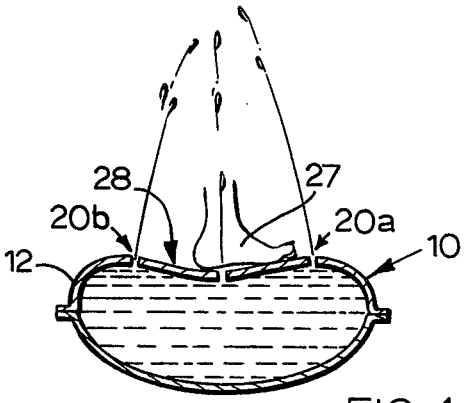
FIG. 4 is a vertical sectional view similar to that taken along the line 3— 3 of FIG. 2, showing the change in the configuration of the recreational item when a localized downward force is applied against the surface thereof.

If the water-delivery hose remains connected and continuously delivers water under pressure to the recreational item 10, the water jets emanating from the perforations 20 (in the absence of anyone jumping on the item) will be relatively constant, of a constant height, and a relatively constant direction. The act of applying a localized downward force at any location on the upper panel 12, as for example by jumping thereon, will not only increase the instantaneous water pressure within the cushion (maintained within the cushion by virtue of the check-valve incorporated into the inlet 18), but will also depress the localized area of the upper panel 12, and cause the perforations 20 in that localized area to change direction, and to angle in toward the cause of the force. This will become clear by comparing FIGS. 3 and 4. In FIG. 4, the foot 27 of a person utilizing the recreational device 10 is causing a localized depression 28 in the upper panel 12, and this results in a change of direction for the specific perforations 20*a* and 20*b*. As can be seen, these specific perforations are now directing the water jets (higher than in FIG. 3 due to the increased pressure) toward the person belonging to the foot 27.

In order to permit the recreational device 10 to function properly, it must have an inherent tendency to maintain the perforated upper panel 12 in the uppermost position. To accomplish this, it is essential that the item have, in any vertical intersecting plane, a cross-section which is somewhat oval and definitely not circular. If the section were circular, it could permit the device to roll over the ground, possibly bringing the perforated panel to the lowermost position, and destroying the spray effect discussed above. It would not be a solution to provide perforations 20 evenly distributed over the entire surface of the item (upper panel and lower panel), because this would allow too much water to escape, and the full effect of increasing only upwardly directed spray jets would be lost (since all spray jets would be increased in force including those directed downwardly into the ground).

It is preferred that the perforations in the upper panel 12 be circular and have a diameter less than five times as great as the thickness of the flexible material itself. The reason for this has to do with stress concentration around the edges of each perforation. It will be appreciated that each specific perforation can be considered to be a cylindrical outlet passage having a definite (though small) length. The pressure of the water diminishes along this length from that obtaining inside the recreational item (which can be as high as 80 P.S.I. or more when it is jumped on) to atmospheric pressure on the outside. This will mean that a constantly decreasing static pressure will obtain along the length of each perforation following a steady diminution from around 80 P.S.I. to atmospheric, and this static pressure will give rise to considerable hoop stresses in the material immediately surrounding the perforation. It is for this reason that it is considered important to maintain the size of a given perforation at less than five times the thickness of the material, because such a diameter limitation will restrict the stresses to which the material is subject. This is due to the fact that the basic integrity of the material in the region of a given perforation is not as greatly disrupted by a small perforation as it is by a relatively large perforation.

It has been found by experimental determination that the total area of all perforations in the upper panel 12 of the recreational item 10 should be in the neighborhood of 0.05 square inches in order to give an optimum spray jet height both when at rest (with constant delivery pressure at around 40 P.S.I.) and when being jumped on during play. At the same time, there should be a sufficient number and scattering of the perforations to allow the "turning inward" effect to take place regardless of where the user jumps on the recreational item. For this reason, in the specific embodiment illustrated in the drawings, fourteen perforations have been provided. Each perforation has, in the preferred embodiment, a diameter of one sixteenth of an inch, so that the total area is 0.0434 square inches.

It has been found that the recreational item 10, when fully inflated, will produce a spray jet height of approximately 8 inches under the usual city water pressure delivery of around 40 P.S.I. The impact of a weight ranging from 50 to 200 pounds can increase the spray height to within the range of 16 inches to 40 inches.

Figure 5:
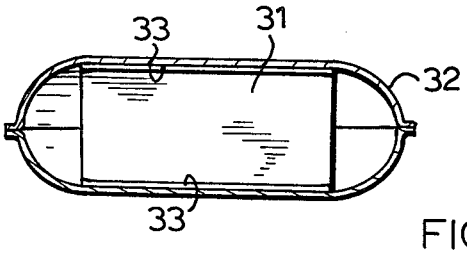
FIG. 5 is a vertical sectional view of a second embodiment of this invention.

Attention is now directed to FIG. 5, which shows in vertical section a second embodiment of this invention. The second embodiment differs from the first in that the oval section is maintained by at least one web 31 which extends vertically across the least dimension of the oval-shaped item 32. The web 31 is attached to the inside of the item at the top and the bottom. At the upper and lower ends of the web 31, a short marginal portion 33 is folded to lie flatly against the respective panel, and is secured thereto by heat sealing in the preferred embodiment. Naturally, any other conventional form of attachment between two such members may be utilized. The web is preferably of a flexible but only slightly resilient material, whereby to be able to maintain the cushion in the oval shape shown in FIG. 5.

I claim:

1. A hollow perforated cushion for play purposes, the cushion being of flexible, water impervious material and having an inlet connection for receiving the end of a water-delivery hose, the cushion when on the ground and filled with water under pressure assuming a shape which yields a non-circular, substantially oval section in any vertical intersecting plane, whereby to define a stable upper surface and to resist rolling over the ground, said stable upper surface being provided with a plurality of perforations therethrough whereby a constant delivery of pressurized water to said cushion will give rise to spray jets at said perforations, the perforations being distributed over said upper surface including areas adjacent its edges, such that a downward localized force applied against said upper surface at any location thereon will increase the water pressure inside said cushion to increase the height and force of said spray jets, and will also depress said surface adjacent said location so that the perforations in the depressed area turn towards the cause of the downward localized force; and at least one web extending vertically across the least dimension of the oval-shaped cushion, the web being attached to the inside of the cushion at the top and at the bottom.

2. The invention claimed in claim 1, in which the perforations are circular and have a diameter less than five times as great as the thickness of said flexible material.

3. The invention claimed in claim 2, in which the flexible material is PVC of a gauge between 12 and 16, and in which there are at least 8 perforations.

4. The invention claimed in claim 3 in which there are 14 perforations arranged in three parallel, spacedapart rows.

* * * * *